US006517499B1

(12) United States Patent
Pereira

(10) Patent No.: US 6,517,499 B1
(45) Date of Patent: Feb. 11, 2003

(54) MASSAGE DEVICE WITH ROTATING ELEMENTS

(76) Inventor: Mercedes R. Pereira, 1563 Vera Cruz La., Weston, FL (US) 33327

( * ) Notice: Subject to any disclaimer, the term of this patent is extended or adjusted under 35 U.S.C. 154(b) by 0 days.

(21) Appl. No.: 09/642,702

(22) Filed: Aug. 15, 2000

(51) Int. Cl.[7] ..... A61H 7/00

(52) U.S. Cl. ..... 601/7; 601/126; 601/133; 601/125

(58) Field of Search ..... 601/118, 122, 601/126, 133, 6, 7, 123, 125, 127; 15/344, 384, 389, 391

(56) References Cited

U.S. PATENT DOCUMENTS 754,463 A * 3/1904 Kroll
1,612,899 A * 1/1927 Ahlgren
5,891,064 A * 4/1999 Van Herk et al. ..... 601/126
5,935,088 A * 8/1999 Bosley ..... 601/7
5,961,475 A * 10/1999 Guitay ..... 601/7
6,090,055 A * 7/2000 Frajdenrajch ..... 601/7

FOREIGN PATENT DOCUMENTS

FR 2057-514 A * 5/1971 ..... 601/133
FR 2579-100 A * 9/1986 ..... 601/133

* cited by examiner

*Primary Examiner*—Justine R. Yu
(74) *Attorney, Agent, or Firm*—M. K. Silverman

(57) ABSTRACT

An massage device includes, within a suction enclosure, a first reversible motor having a power shaft output which provides input to a gear assembly for mechanically converting reciprocating rotational motion of a power shaft to reciprocating linear motion. This reciprocating linear motion is communicated to respective opposing massage applicator rollers to facilitate compressive and de-compressive action suitable for application to human tissue in the treatment of cellulite and related conditions. Disposed within the same housing as the first motor is a second reversible motor which, thru a belt system, selectably and synchronously rotates and counter-rotates both rollers independently of their compressive and de-compressive action. The suction function is actuated upon any operation of the second motor.

3 Claims, 8 Drawing Sheets

FIG. I

MASSAGE DEVICE WITH ROTATING ELEMENTS

BACKGROUND OF THE INVENTION

The present invention relates to an improved apparatus for massaging the human body and, more particularly, to a massage device having a pair of opposed applicators that are derivable in a defined linear motion and a selectable rotating or counter-rotating motion which is independent of the linear displacement of the applicators.

Electrically driven vibrators and massagers are well known in the art. However, those that are hand held generally require the motor portion thereof be held immobile while a single driven applicator portion moves through a prescribed motion which, typically, is linear, rotational, vibratory or some combination thereof. The applicator is then applied to a body part to impart such motion thereto. However, various conditions, for example, arthritis and certain joint and cellulite related conditions are more amenable to massage therapy if a stretching motion of the applicator is available.

In the prior art, various types of equipment have been proposed to facilitate such massage. Generally, such equipment exerts, on the selected portion of the human body, an action of pressure, tissue displacement, friction, undulation, or some combination thereof. However, little in the prior art addresses the induction of combined stresses in what is known in the art of massage or endermology as a "rolling palpation" which has particular application in the treatment of coetaneous, cellulitis and other dermatologic conditions. The role of the palpation technique involves furnishing to a subject a combination of a pinching action and continuous rolling action across a fixed tissue specific displacement of the pinched area to generate a roll in the skin while at the same time exerting pressure upon opposite sides thereof. Therein, the direction of rotation of the applications must conform to the linear direction of the outline device. Such an objective of the prior art is reflected in U.S. Pat. No. 4,729,368 (1988) to Guitay, entitled Apparatus for Massaging the Human Body and U.S. Pat. No. 5,665,053 (1997) to Jacobs, entitled Apparatus for Performing Endermology. However, such references teach devices which, while functional in theory, do not provide a durable, stable and reliable mechanical system capable of operating without malfunction over an extended period of time. Because Guitay is reliant upon the use of springs, it is inherently less stable than a gear-operated device and cannot provide defined, constant and reliable tissue displacement during operation thereof. Jacobs is dependent upon the use of ultrasound, thereby rendering it subject to regulation as a medical device.

The prior art, inclusive of the present invention, employs suction against the human skin to optimize massage techniques applicable in the treatment of cellulite and related skin disorders. Understandably, the coordination and integration of the effects of the suction with the balancing of spring constants has made for a formidable engineering problem and, as above noted, one which has resulted in problems of maintenance and durability. The present invention therefore seeks to simplify and improve the mechanics of a variable displacement and rotating massage device so that, over extended periods, internal suction may be used without degrading the durability and accuracy thereof.

SUMMARY OF THE INVENTION

A massage device includes, within a selectable suction enclosure, a first reversible motor having a power shaft output which provides input to a gear assembly for mechanically converting rotational motion of said power shaft to reversible linear motion. Such variable linear motion is communicated to respective massage applicator rollers to facilitate a defined displacement therebetween which is suitable for application to human tissue in the treatment of cellulite and in any related conditions. Disposed within the same housing as said first motor is a second reversible motor which, thru belt means, selectably rotates or counter-rotates axles of said rollers independently of the relative displacement thereof. The suction function is controlled by the means of control of the second motor.

It is accordingly an object of the invention to provide an improved apparatus for performing massage for physical therapy.

It is another object to provide a device of the above type having improved efficiency when used in the treatment of cellulitis, cutaneous and other dermatologic zones of the human body.

It is a further object of the invention to provide a device of the above type which is not reliant upon the use of springs or biasing means for the operability thereof.

It is a still further object to provide a massage device which is durable during long term use within a negative pressure environment.

It is a still further object of the invention to provide a means of the above type which employs double acting applicators which respectively rotate and counter-rotate independent of the displacement therebetween.

The above and yet other objects and advantages of the present invention will become apparent from the hereinafter set forth Brief Description of the Drawings and Detailed Description of the Invention set forth herein.

DETAILED DESCRIPTION OF THE INVENTION

Figure 1:
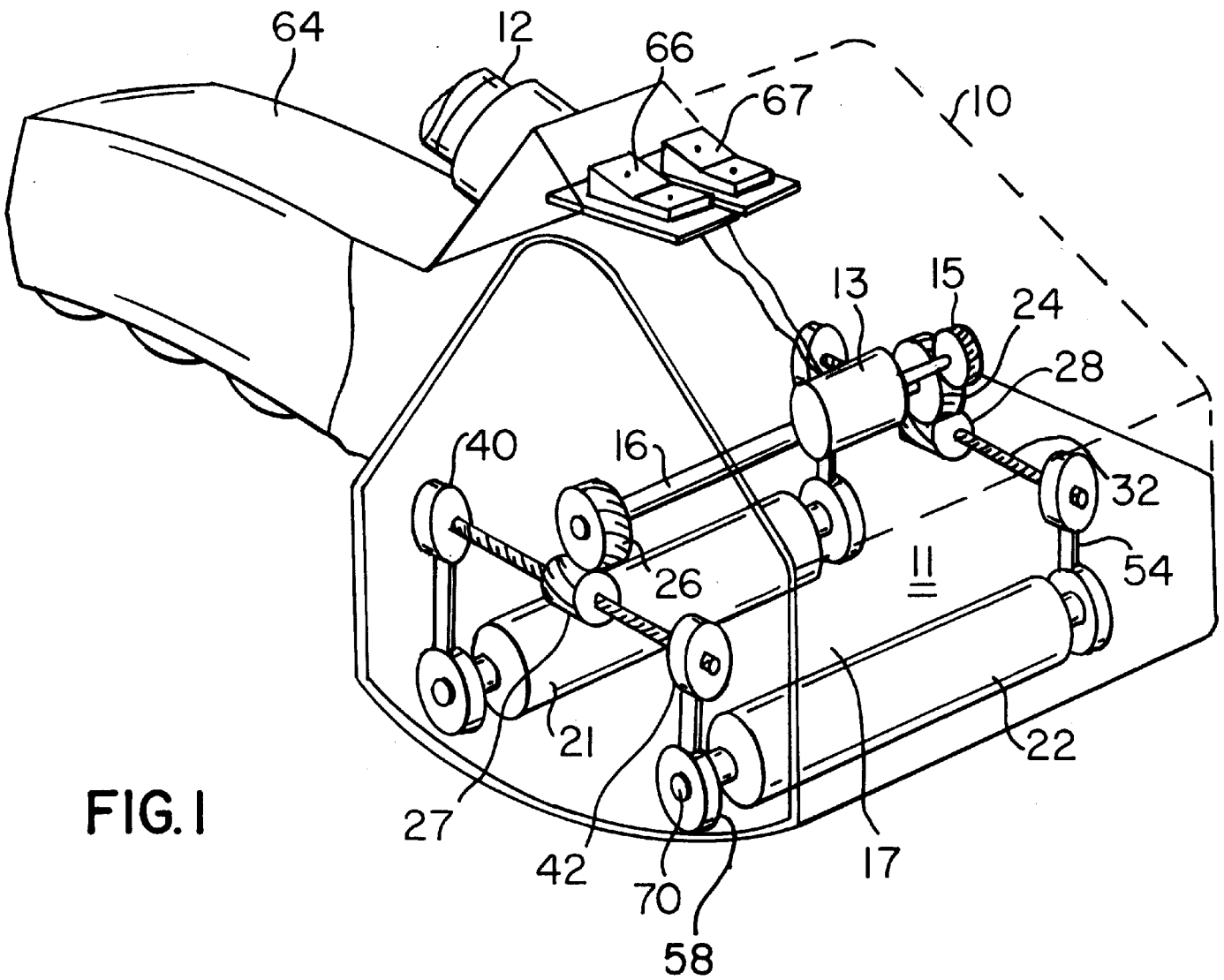
FIG. 1 is a perspective schematic view of the gear drive assembly of the inventive double action massage apparatus and its related suction-based housing.

With reference to the schematic views of FIGS. 1, 3, 7 and 8, the inventive endermology massage device may be seen to include a handle portion 64 and a housing 10 including therein a suction region 11, an input of which is provided through a vacuum input conduit 12. Accordingly, negative pressure is provided from conduit 12 to suction region 11 through an opening 9 of conduit 12 within housing 10. It is understood that there is provided external vacuum means (not shown) which communicate with vacuum input conduit 12.

Figure 2:
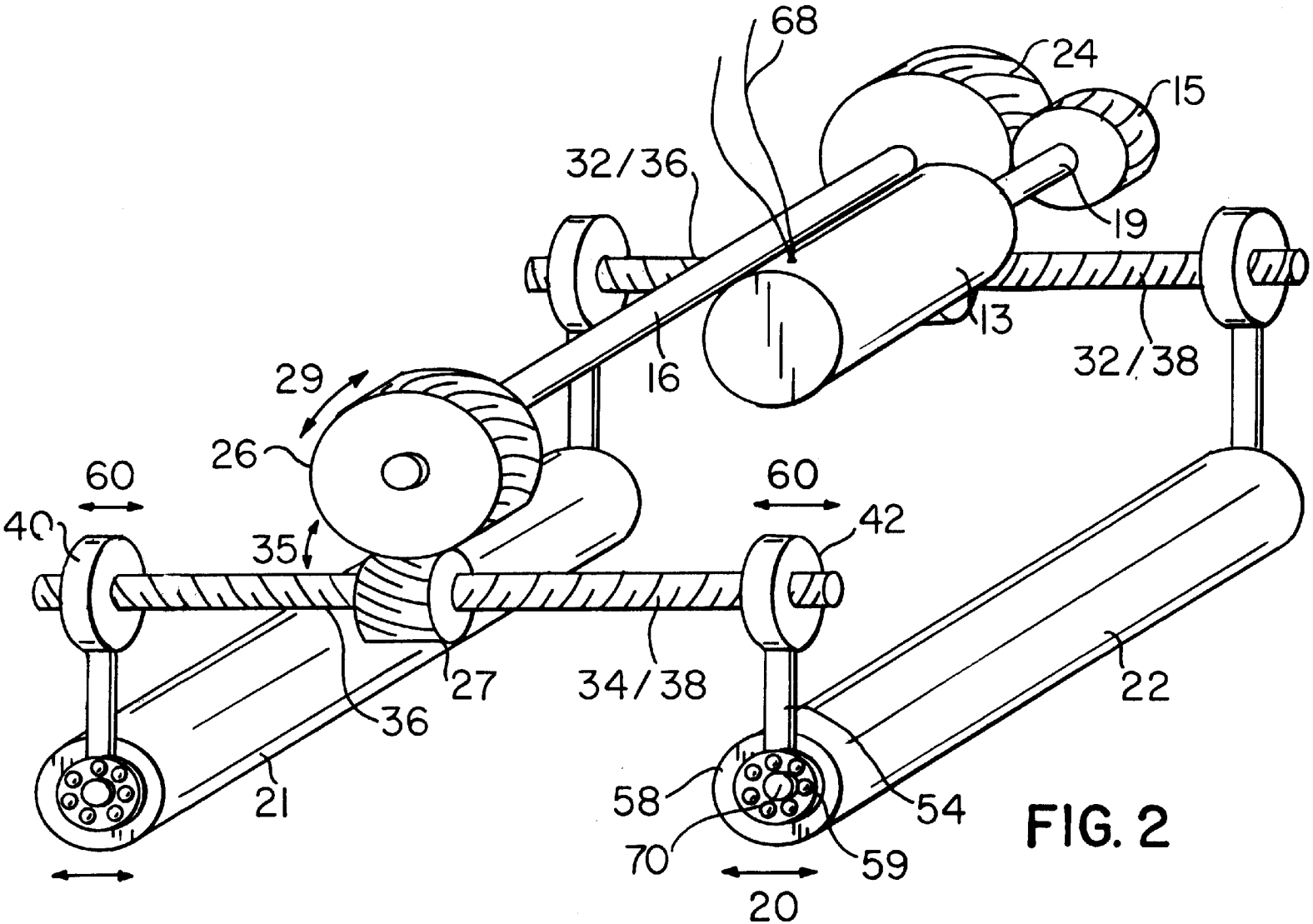
FIG. 2 is an enlarged view of the gear assembly of FIG. 1
Figure 3:
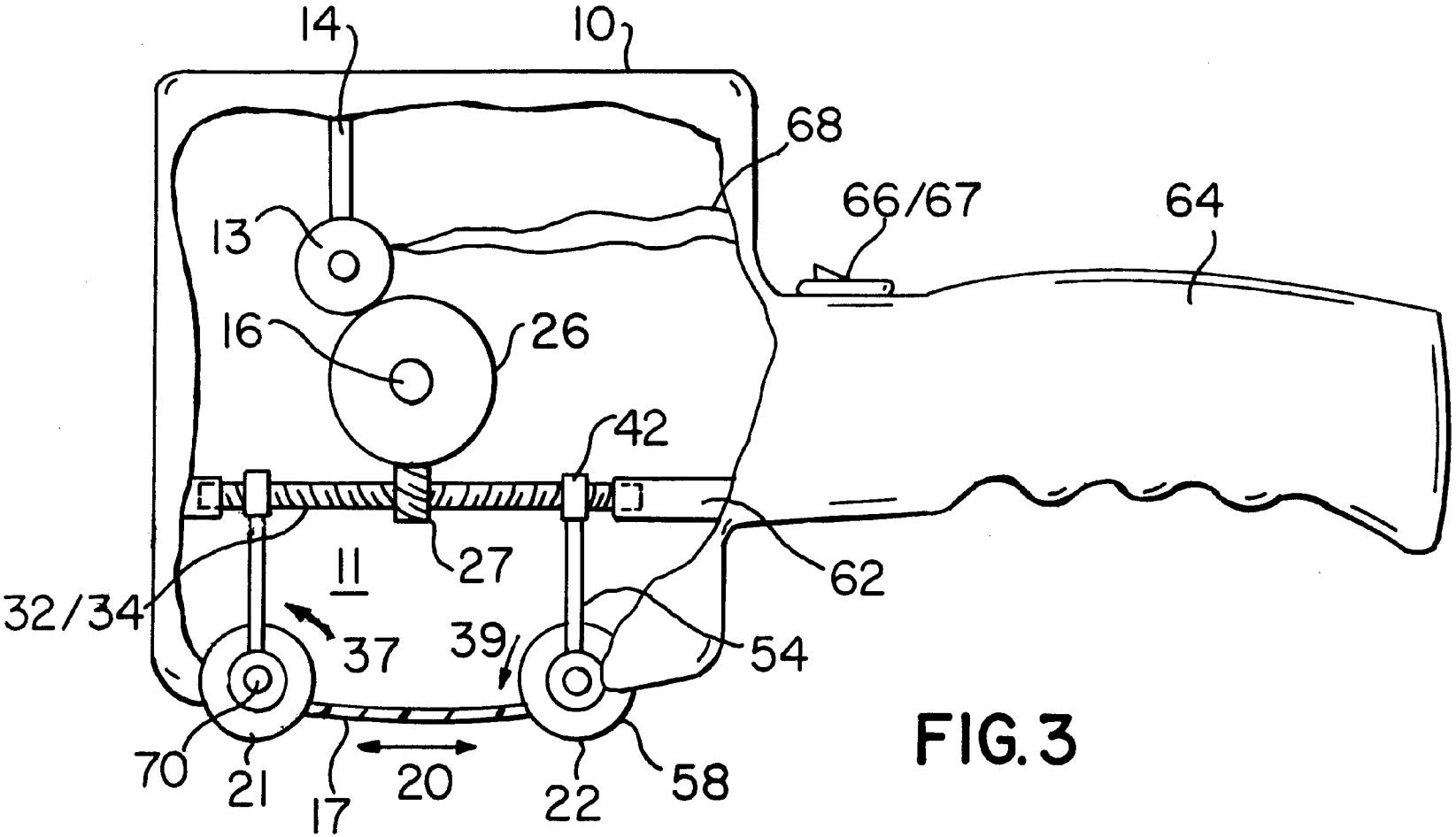
FIG. 3 is an axial side breakaway view of the inventive apparatus, showing direction of angular rotation of the rollers relative to the displacement therebetween.
Figure 5:
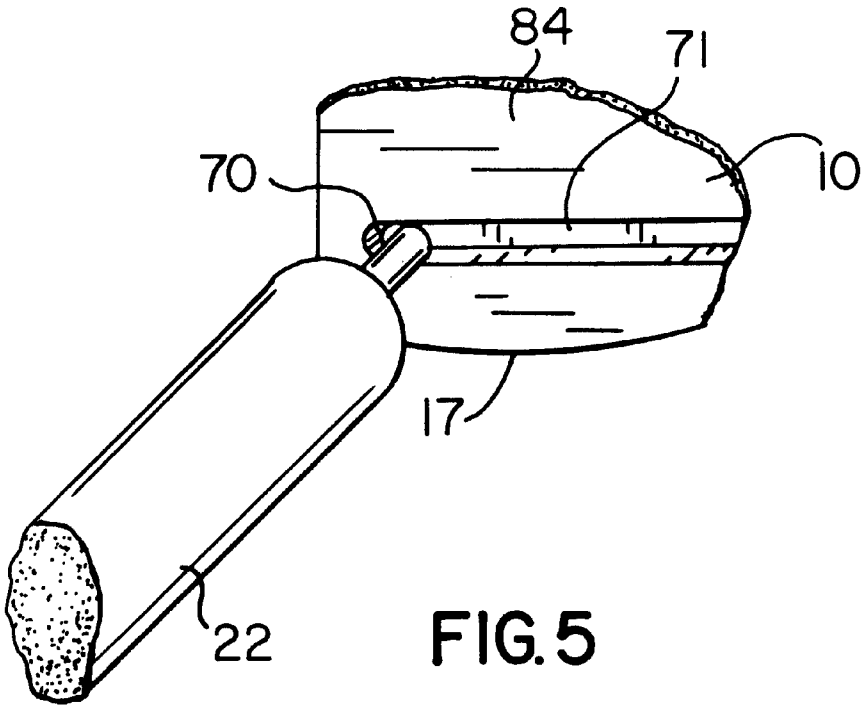
FIG. 5 is a breakaway perspective view of the guide channels for the double acting rollers.

In FIGS. 1 to 3, the invention may be seen to further include two spaced apart rollers 21 and 22, each exhibiting a cylindrical outer surface and an axle 70 thereof. Said axle, and therefore, the rollers 21 and 22, are thereby respectively parallel with each other. As may be noted in FIG. 5, the axles 70 of the rollers 21 and 22 are slidably mounted within guide channels 71 which limit the freedom of motion of the rollers to the path of linear reversible motion 20 as shown in FIGS. 2 and 3. Therein is also shown first reversible motor 13 having power input 68 and switch 66. This motor will produce the motion shown by arrows 37 and 39 of FIG. 3, or the opposite thereof. The motor is secured to said housing 10 by motor mount 14. Output 19 of motor 13 is characterized by rotational reciprocation, also known as an oscillating motion. Accordingly, motor 13 is termed a first reversible motor. The alternating rotational and counter-rotational output 19 of motor 13 is communicated to a driving gear 15 which, in turn, imparts its reversible motion 29 to a driven gear 24 and, thru shaft 16 to a second driven gear 26. This motion is in turn imparted to pinion gears 27 and 28 which are each mounted upon co-parallel shafts 32 and 34 which are secured within journals 62, thus causing polar motion 35. See FIGS. 2 and 3. These shafts are characterized by threadings 36 and 38 in which threading 36 is counter-rotational, or opposite in spiral, to threading 38. Accordingly, upper gear elements 40 and 42, which are mounted at opposite ends of shafts 32 and 34 will reciprocate linearly in the manner shown by arrows 60, this as a function of the reciprocating polar motion 35 of the pinion gears. Accordingly, the combination of gear 15, gears 24/26 and gears 27/28, taken in combination with the counter threaded portions 36 and 38 of shafts 32 and 34 respectively, comprise means for converting the reversible rotary output 19 of motor 13 into adjustable linear displacement 60.

Figure 4:
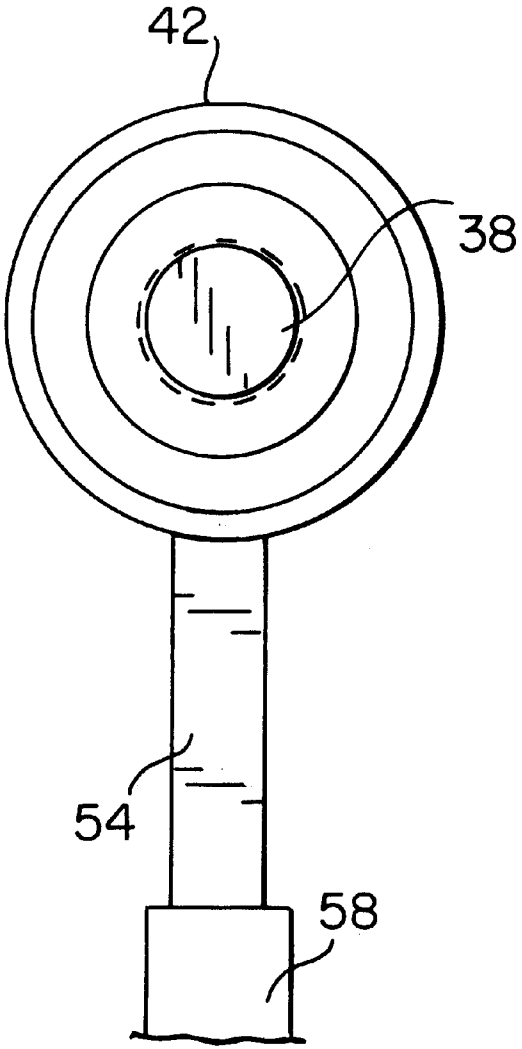
FIG. 4 is an enlarged axial end view of the lower part of the gear assembly.

By securement of vertical elements 54 to gears 40 and 42, said linear reciprocating motion 60 is communicated to an outer ring 58 (see FIGS. 2 to 4) of a ball bearing structure 59 (shown in breakaway view in FIG. 2) within ring 58. Therein axles 70 are journalled. It is to be appreciated that said ball bearing structure represents but one of many mechanical means of communicating said linear reciprocation motion 60 to axles 70 of rollers 21 and 22 to thereby provide linear reciprocating motion 20 thereto.

With reference to FIG. 3, housing 10 may be seen to also include a variable size opening 17 which provides communication between suction region 11 and a surface of the human body to be treated by the instant device. The size of opening 17 will, of course, vary as function of the linear reciprocation motion 20 of rollers 21 and 22.

Figure 7:
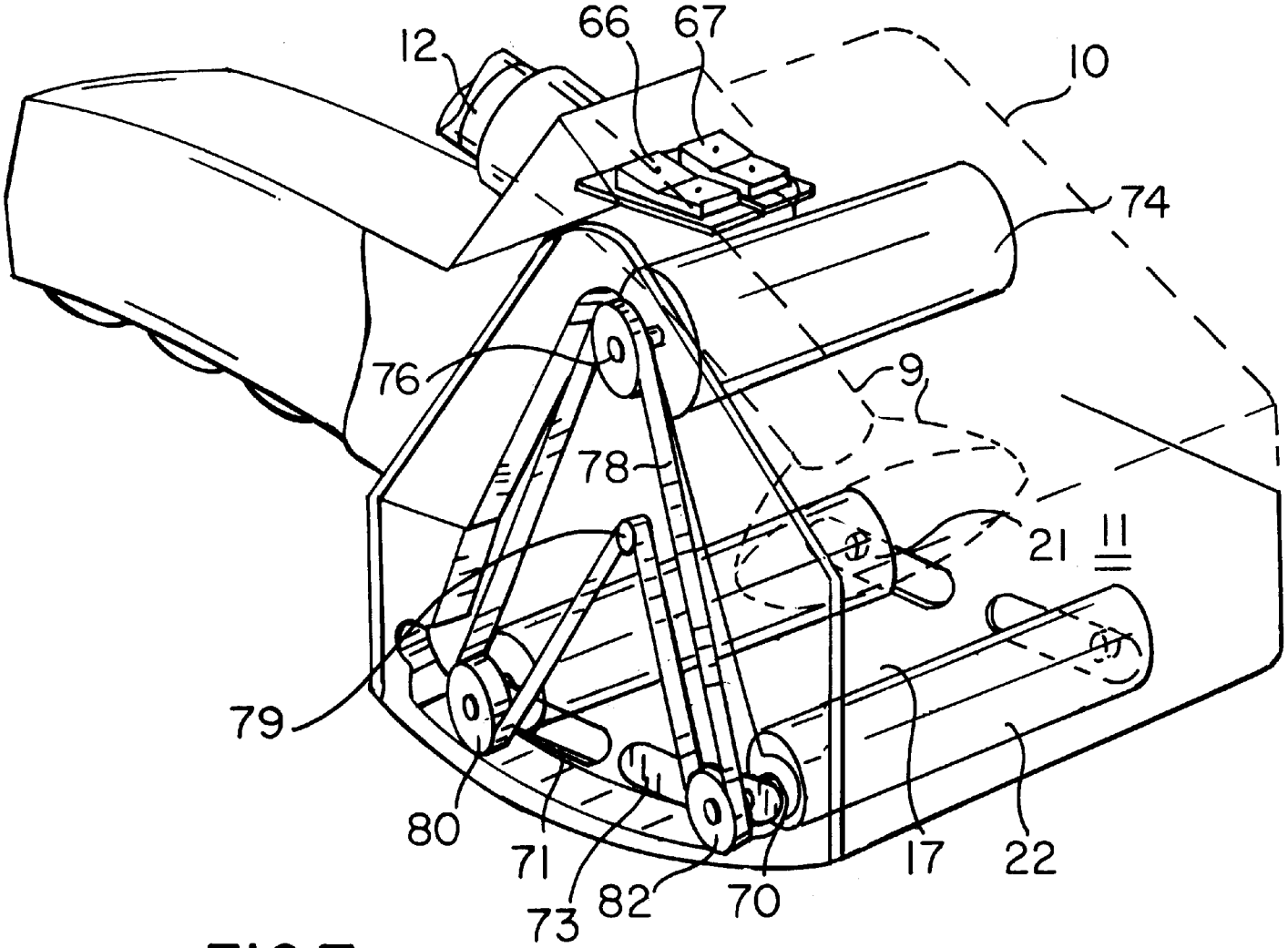
FIG. 7 is a perspective schematic view of the belt control assembly of the inventive apparatus.

Further shown in FIGS. 1, 3 and 7 is a polarity reversal switch 66 which is used to effect rotation of motor 13.

Figure 6:
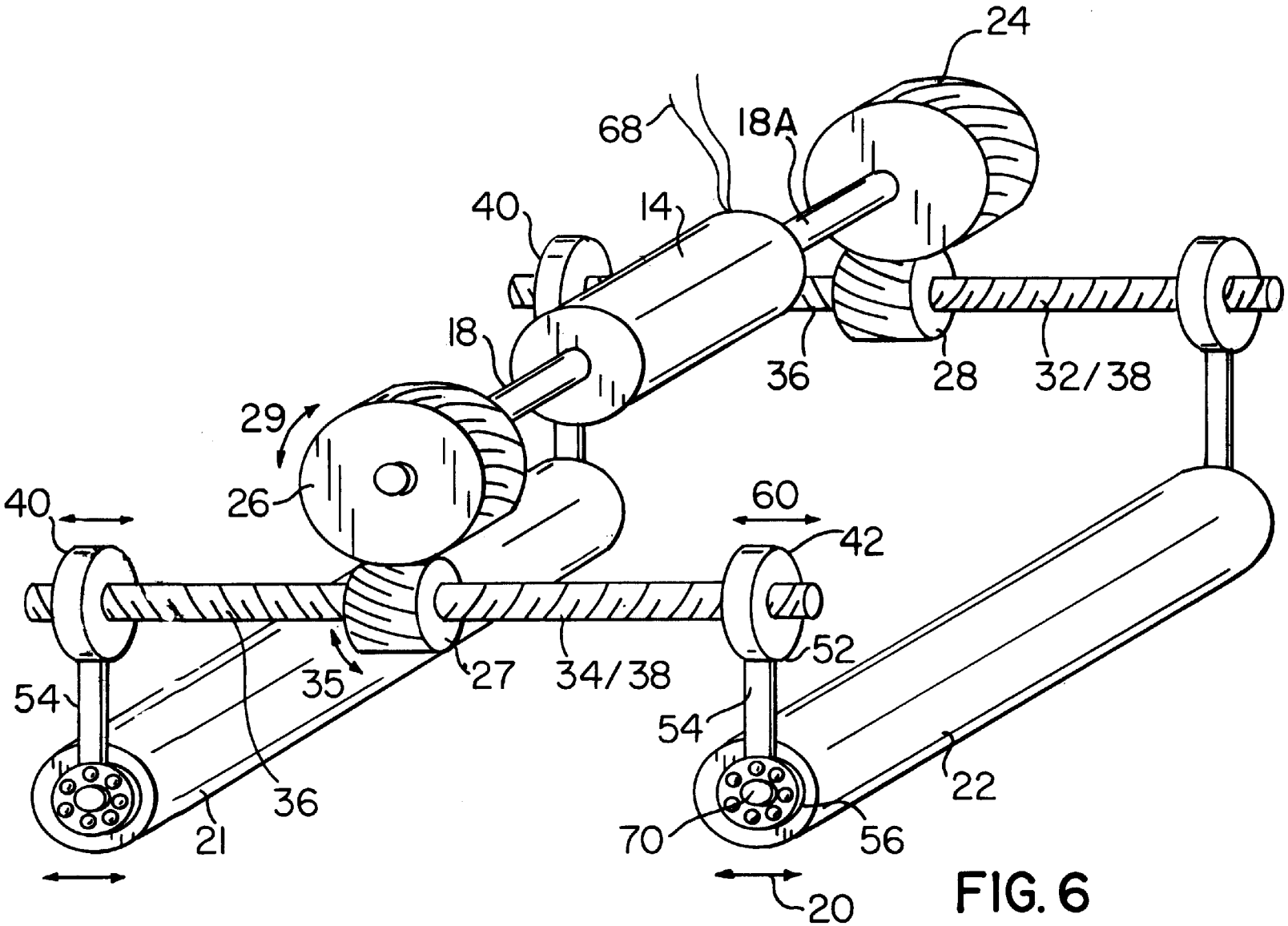
FIG. 6 is a perspective view of a second embodiment of the gear assembly shown in FIG. 2

With reference to the view of FIG. 6, there is shown an alternate embodiment of the gear assembly of FIG. 2 which, as may be noted, differs only in its use of an oscillating motor 14 having dual co-axial power outputs 17 and 18 which are colinear with the axes of rotation of gears 24 and 26. Thereby, the need for driving gear 15 is eliminated and, therewith, a more symmetrical transmission of rotational motion from the first oscillating motor to the gears 24 and 26 is accomplished.

Figure 8:
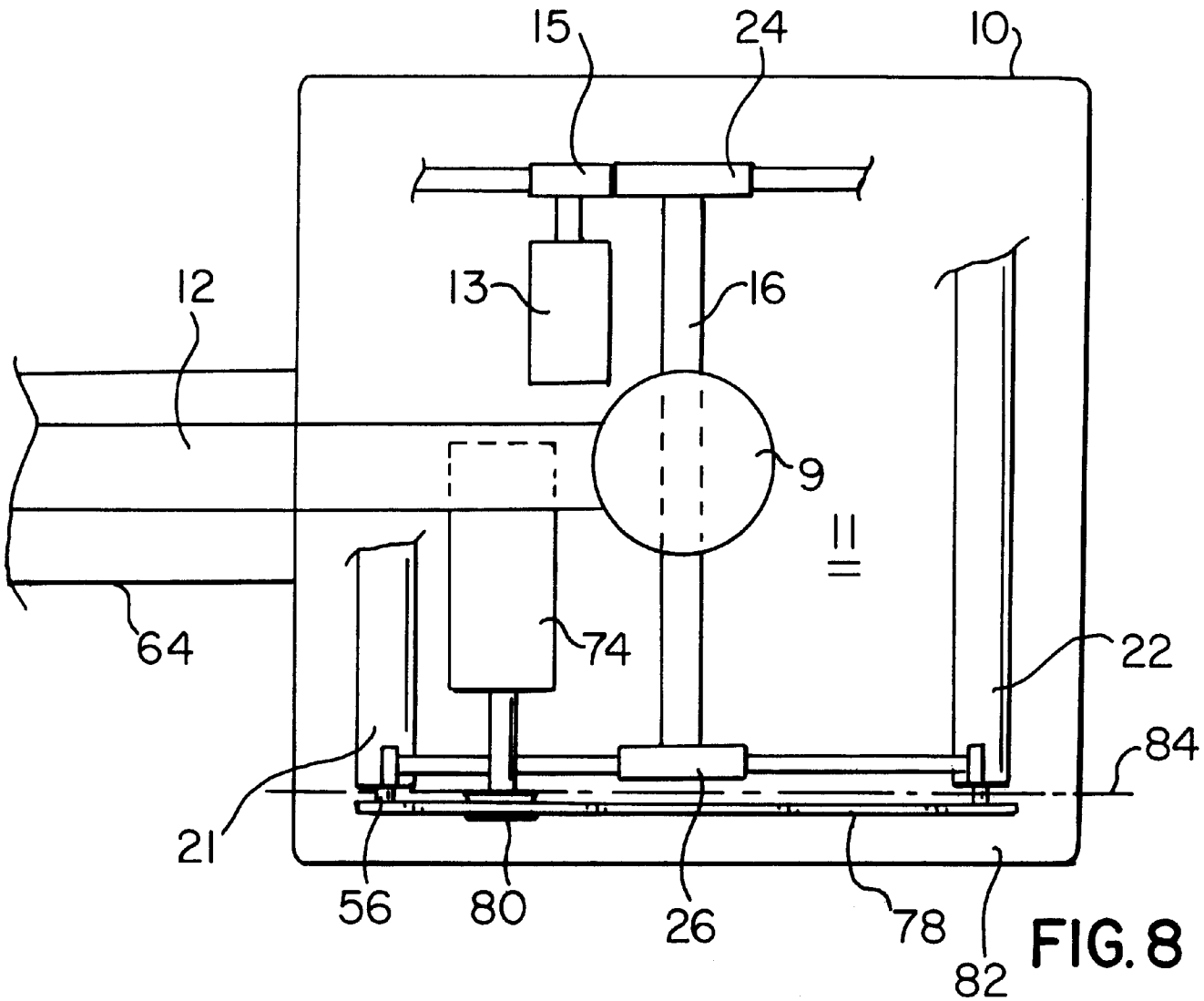
FIG. 8 is a top schematic view of the integrated gear drive and belt control assemblies.
Figure 9:
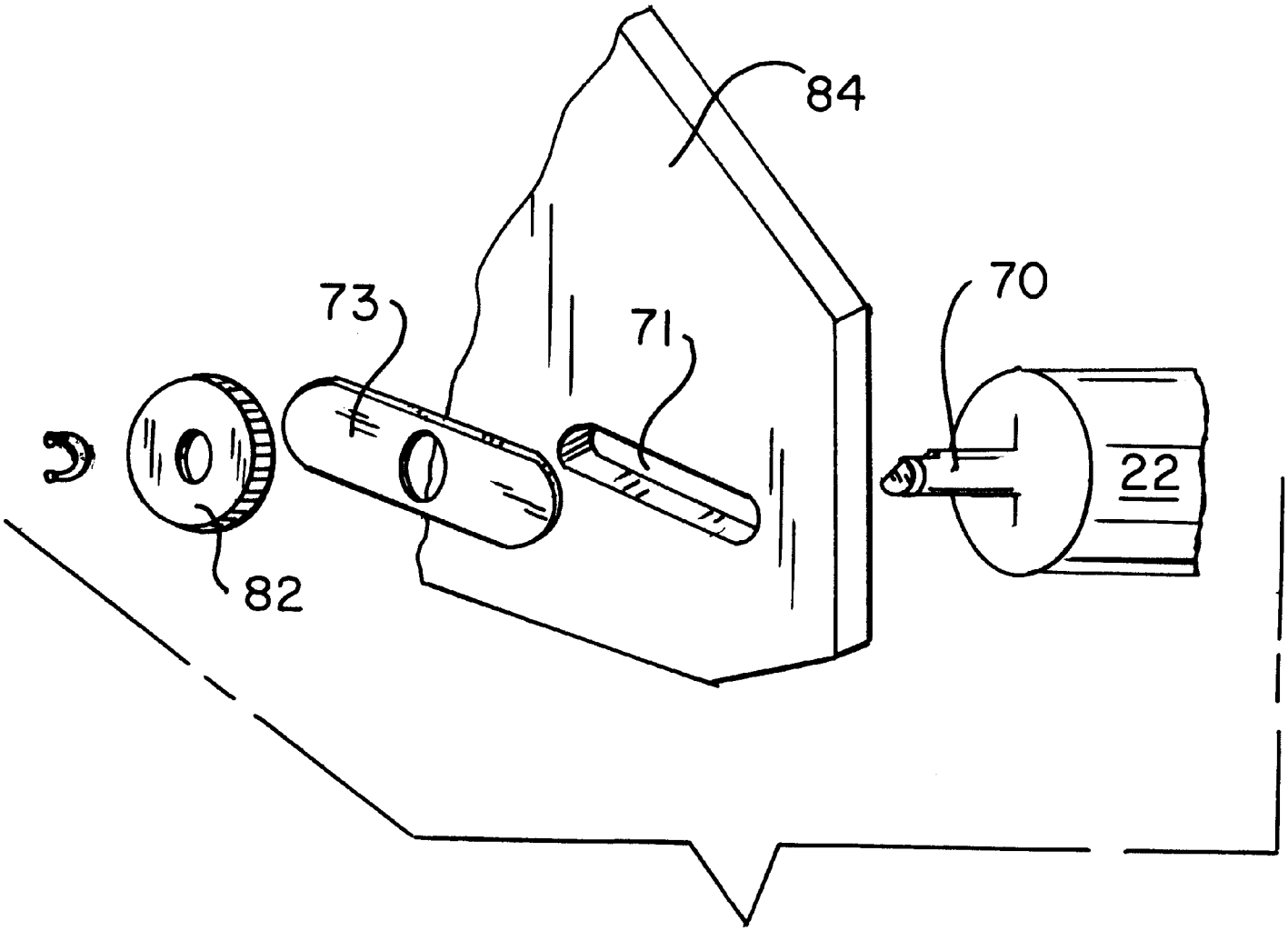

With reference to FIGS. 7 and 8 there is shown, in perspective schematic view, a belt control assembly provided within housing 10 of the inventive structure. More particularly, there is provided a second reversible motor 74, activated by a polarity-reversal switch 67, which, through driving gear 76, causes selectable rotational and counter-rotational motion of belt 78 which, in turn, engages belt sprockets 80 and 82 which are journalled integrally upon axle 70 of the roller but are positioned outside of the device housing 10, that is, are positioned axially outwardly of lower gear elements 56 which, as may be noted in FIG. 8, are inside of vacuum seal line 84 of housing 10. The use of a single belt 78 assures that the respective rollers will rotate in directional and rate synchronization with each other. See arrows 37 and 39 in FIG. 3. Resultant of the above function of second motor 74 and its associated belt assembly, rollers 21 and 22 are selectably reversed using switch 67, independently of linear motion 20 of the rollers 21 and 22 effected by the first motor 13 and its associated gear assembly as described above. In a preferred embodiment of the invention, the direction of rotation of reversal motor 74 will reverse with selectable actuation of switch 67, this independent of the suction effects of the system upon the body area of interest. Therein, switch 67 also actuates the suction function of the device. It is, accordingly, to be appreciated that the inventive massage device operates through a combination of suction, said linear reciprocating motion 20, and said selectable rotational motion of the rollers imparted by second oscillating motor 74 and its associated assembly.

In FIG. 7 are also shown flaps or suction enclosure means 71 and 73 which act to minimize escape of pressure during reciprocating action of the rollers.

In the top view of FIG. 8, the first and second motors and their assemblies, as described above, are shown integrated within housing 10.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention, what I claim as new, useful and non-obvious and, accordingly, secure by Letters Patent of the United States is:

1. A massage device, comprising:

(a) two spaced-apart rollers, each having a cylindrical outer surface and an axis of rotation having first and second ends, each of said rollers respectively parallel to each other, said ends of each of said axes slidably mounted within a respective assembly including a journal in support of each of said axes of said roller;

(b) a housing including a suction region thereof in communication with a source of negative pressure, said housing including an opening for communication with the human body, said opening also communicating with said suction region of said housing, said opening disposed within a lower surface thereof and further defined by variable positions of said axes of said spaced-apart rollers;

(c) within said housing, a first reversible motor having selectably rotational or counter-rotational angular outputs, and control means for actuating each respective output by a single manual switch;

(d) within said housing, gear assembly means powered by said first motor, for converting each of said angular outputs of said first motor into respective reciprocating linear movements to thereby vary said positions of said rollers and thereby vary a width of said opening of said housing, in which respective compressive and de-compressive functions are thereby provided to said spaced apart rollers;

(e) within said housing, a second reversible motor having manually selectable respective rotational and counter-rotational outputs, and control means therefore; and (f) belt means, powered by said respective outputs of said second reversible motor, for communication to said axis of said rollers of selectably reversible mutually synchronous rotational and counter-rotational motion.

2. The device as recited in claim 1 in which said housing further comprises:

sealing flaps mounted to said housing about said roller assemblies and constantly biased into contact with said housing to comprise means for substantially air tight sealing between said housing and ends said rollers.

3. The device as recited in claim 1 in which said control means for said second motor further comprises:

means for actuation of said negative pressure of said suction region.

* * * * *